US009828551B2

(12) United States Patent
Patten

(10) Patent No.: US 9,828,551 B2
(45) Date of Patent: Nov. 28, 2017

(54) COMPOSITE FEEDSTOCK FOR RECOVERY OF HYDROCARBONS FROM HYDROCARBONACEOUS MATERIAL

(71) Applicant: Red Leaf Resources, Inc., South Jordan, UT (US)

(72) Inventor: James W. Patten, South Jordan, UT (US)

(73) Assignee: Red Leaf Resources, Inc., Salt Lake City, UT (US)

( * ) Notice: Subject to any disclaimer, the term of this patent is extended or adjusted under 35 U.S.C. 154(b) by 126 days.

(21) Appl. No.: 14/444,654

(22) Filed: Jul. 28, 2014

(65) Prior Publication Data

US 2015/0027930 A1 Jan. 29, 2015

Related U.S. Application Data

(60) Provisional application No. 61/859,679, filed on Jul. 29, 2013.

(51) Int. Cl.

| | |
|---|---|
| ***C10G 1/04*** | (2006.01) |
| ***C10G 1/02*** | (2006.01) |
| ***C10G 31/06*** | (2006.01) |
| ***C10B 53/06*** | (2006.01) |
| ***C10G 1/00*** | (2006.01) |
| *C10G 53/06* | (2006.01) |

(52) U.S. Cl.

CPC ..... *C10G 1/045* (2013.01); *C10B 53/06* (2013.01); *C10G 1/008* (2013.01); *C10G 1/02* (2013.01); *C10G 31/06* (2013.01)

(58) Field of Classification Search

CPC ..... C10G 1/045; C10G 1/086; C10G 31/06

See application file for complete search history.

(56) References Cited

U.S. PATENT DOCUMENTS

| | | | |
|---|---|---|---|
| 2,173,842 | A | 9/1939 | Horner |
| 4,387,016 | A | 6/1983 | Gagon |
| 4,529,497 | A | 7/1985 | Watson et al. |

(Continued)

FOREIGN PATENT DOCUMENTS

WO WO 2008/028255 A1 3/2008

OTHER PUBLICATIONS

PCT Application PCT/US2014/048474; filed Jul. 28, 2014; Red Leaf Resources; International Search Report dated Nov. 14, 2014.

*Primary Examiner* — Brian McCaig

(74) *Attorney, Agent, or Firm* — Thorpe North & Western, LLP

(57) ABSTRACT

A method of reducing settling of residual comminuted hydrocarbonaceous material during processing can comprise forming a constructed permeability control infrastructure which defines a substantially encapsulated volume; introducing a composite comminuted hydrocarbonaceous material into the control infrastructure to form a permeable body, said composite hydrocarbonaceous material comprising a comminuted hydrocarbonaceous material and a structural material; and heating the permeable body sufficient to remove hydrocarbons therefrom such that the hydrocarbonaceous material is substantially stationary during heating, exclusive of subsidence and settling. The structural material can provide structural integrity to the permeable body sufficient to maintain convective flow of fluids throughout the permeable body during heating.

22 Claims, 4 Drawing Sheets

(56) References Cited

U.S. PATENT DOCUMENTS

| | | | | |
|---|---|---|---|---|
| 5,228,804 | A | 7/1993 | Balch | |
| 7,862,705 | B2 | 1/2011 | Dana et al. | |
| 2003/0102124 | A1 | 6/2003 | Vinegar et al. | |
| 2003/0147697 | A1 | 8/2003 | Brady et al. | |
| 2008/0190818 | A1* | 8/2008 | Dana | C10B 47/02 208/424 |
| 2010/0200468 | A1 | 8/2010 | Dana et al. | |
| 2011/0138649 | A1 | 6/2011 | Patten | |

* cited by examiner

COMPOSITE FEEDSTOCK FOR RECOVERY OF HYDROCARBONS FROM HYDROCARBONACEOUS MATERIAL

RELATED APPLICATIONS

This application claims priority of U.S. Provisional Application No. 61/859,679, filed Jul. 29, 2013, which is incorporated by reference herein.

BACKGROUND

Processing of hydrocarbonaceous materials can often involve heating of feedstock materials to produce and remove hydrocarbons. A wide variety of processes can be used, however most processes inherently have particular challenges which limit productivity and large scale use. Hydrocarbonaceous materials such as tar sands and oil shale have been processed using both above-ground and in situ processing. Other hydrocarbonaceous materials such as coal have been processed using a wide array of technologies such as coal gasification and coal liquefaction. Recent developments in tar sands and oil shale processing technologies, in particular, continue to improve production efficiencies and reduce environmental impact. However, various challenges remain in terms of process stability, environmental impact and yields, among others.

SUMMARY

Settling of hydrocarbonaceous materials during processing can reduce porosity which adversely affects convective heat flow throughout the materials. Settling can be especially pronounced for materials having a relatively high organic content. As such, a method of reducing settling of residual comminuted hydrocarbonaceous material during processing can comprise forming a constructed permeability control infrastructure which defines a substantially encapsulated volume. The control infrastructure can be formed to create a boundary envelope across which mass transfer can be controlled and in some cases substantially eliminated. A composite comminuted hydrocarbonaceous material can be introduced into the control infrastructure to form a permeable body. Specifically, the composite hydrocarbonaceous material can include a comminuted hydrocarbonaceous material and a structural material. The permeable body is then heated sufficient to remove hydrocarbons therefrom. Although not always required, the hydrocarbonaceous material can typically be substantially stationary during heating, exclusive of subsidence and settling. The structural material provides structural integrity to the permeable body sufficient to maintain convective flow of fluids throughout the permeable body during heating.

Additionally, a corresponding constructed permeability control infrastructure can comprise a permeability control impoundment defining a substantially encapsulated volume and a composite comminuted hydrocarbonaceous material within the encapsulated volume forming a permeable body of hydrocarbonaceous material. The composite comminuted hydrocarbonaceous material can similarly comprise comminuted hydrocarbonaceous material and structural material having an initial porosity. During heating of the permeable body, the porosity can generally decrease over time. However, the structural material is selected and adapted to maintain the porosity of the permeable body during heating of the permeable body within a target porosity range.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
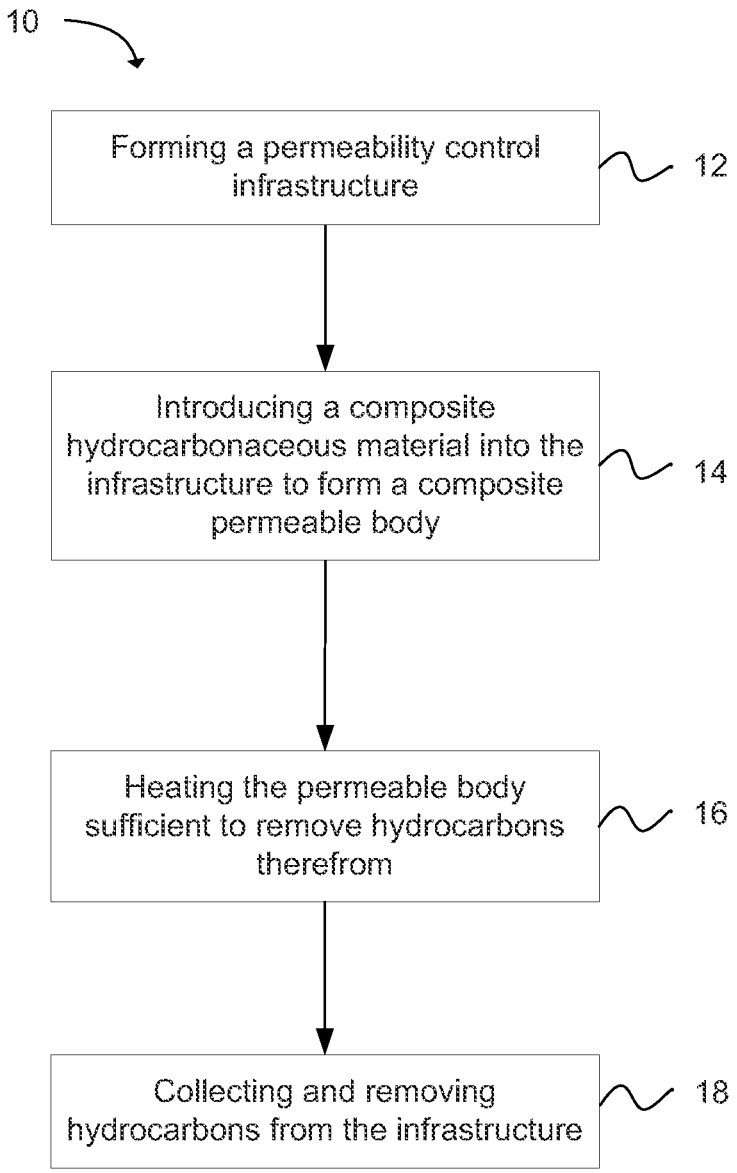
FIG. 1 is a flow chart of a method in accordance with one embodiment of the present invention.

It should be noted that the figures are merely exemplary of several embodiments of the present invention and no limitations on the scope of the present invention are intended thereby. Further, the figures are generally not drawn to scale, but are drafted for purposes of convenience and clarity in illustrating various aspects of the invention.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used. The singular forms "a," "an," and "the" include plural references unless the context clearly dictates otherwise. Thus, for example, reference to "a wall" includes reference to one or more of such structures, "a permeable body" includes reference to one or more of such materials, and "a heating step" refers to one or more of such steps.

As used herein, "constructed infrastructure" and "constructed permeability control infrastructure" refers to an encapsulating structure which is substantially entirely man made, as opposed to freeze walls, sulfur walls, or other barriers which are formed by modification or filling pores of an existing geological formation. The constructed permeability control infrastructure can typically be substantially free of undisturbed geological formations, although the infrastructure can be formed adjacent or in direct contact with an undisturbed formation. The infrastructure can typically be formed using compacted earthen material or compacted particulate material. As such, infrastructure walls often do not have independent structural integrity apart from underlying earth foundation.

As used herein, "earthen material" refers to natural materials which are recovered from the earth with only mechanical modifications such as, but not limited to clay (e.g. bentonite clay, montmorillonite, kaolinite, illite, chlorite, vermiculite, and other swelling clays), gravel, rock, compacted fill, soil, and the like. Gravel, for example, may be combined with cement to form concrete. Frequently, clay amended soil can be combined with water to form a hydrated clay layer which acts as a fluid barrier. However, spent oil shale can also be used to form at least a portion of the earthen material used in infrastructure walls.

As used herein, "hydrocarbonaceous material" refers to hydrocarbon-containing material from which hydrocarbon products can be extracted or derived. For example, hydrocarbons may be extracted directly as a liquid, removed via solvent extraction, directly vaporized or otherwise removed from the material. However, many hydrocarbonaceous materials contain kerogen, bitumen, or other complex hydrocarbons which is converted to a hydrocarbon through heating and pyrolysis. Hydrocarbonaceous materials can include, but is not limited to, oil shale, tar sands, coal, lignite, bitumen, peat, biomass, and other organic rich rock.

As used herein, "structural material" refers to non-hydrocarbonaceous or non-hydrocarbon yielding material that provides structural integrity to a permeable body sufficient to maintain convective flow of fluids throughout the permeable body during extraction of hydrocarbons. For example, during heating a portion of the permeable body is removed as hydrocarbons are liberated. The remaining materials (e.g. silica and other minerals) of the hydrocarbonaceous portion of the permeable body can at least partially collapse. The degree of collapse typically corresponds to proportions of mineral versus convertible hydrocarbonaceous material (i.e. kerogen, bitumen, etc). A structural material provides a mechanical support to the permeable body as surrounding hydrocarbonaceous material is removed as hydrocarbons.

As used herein, "impoundment" refers to a structure designed to hold or retain an accumulation of fluid and/or solid moveable materials. An impoundment generally derives at least a substantial portion of foundation and structural support from earthen materials. Thus, the control walls of the present invention do not always have independent strength or structural integrity apart from the ground and/or native formation against which they are formed. Further, an impoundment typically utilizes earthen materials and at least a portion of walls formed as berms of compacted earthen material.

As used herein, "composite comminuted hydrocarbonaceous material" refers to a mixture of comminuted hydrocarbonaceous material and structural material. The structural material has a different composition than the comminuted hydrocarbonaceous material and imparts increased structural integrity to the permeably body over a permeable body using exclusively the comminuted hydrocarbonaceous material.

As used herein, "permeable body" refers to a mass of composite comminuted hydrocarbonaceous material having a relatively high permeability which exceeds permeability of a solid undisturbed formation of the same composition. Permeable bodies suitable for use in the present invention can have greater than about 10% void space and typically have void space from about 20% to 50%, although other ranges may be suitable. Allowing for high permeability facilitates heating of the body through convection as the primary heat transfer mechanism while also substantially reducing costs associated with crushing to very small sizes, e.g. below about 2.5 to about 1 cm. Specific target void space can vary depending on the particular hydrocarbonaceous material and desired process times or conditions.

As used herein, "mined" refers to a material which has been removed or disturbed from an original stratographic or geological location to a second and different location. Typically, mined material can be produced by rubbilizing, crushing, explosively detonating, or otherwise removing material from a geologic formation.

As used herein, "substantially stationary" refers to nearly stationary positioning of materials with a degree of allowance for subsidence and/or settling as hydrocarbons are removed from the hydrocarbonaceous material. In contrast, any circulation and/or flow of hydrocarbonaceous material such as that found in fluidized beds or rotating retorts involves highly substantial movement and handling of hydrocarbonaceous material.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, and sub-ranges such as 10 to 50, 20 to 100, etc.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Reducing Settling of Residual Material

Referring to FIG. 1, a method 10 of reducing settling of residual comminuted hydrocarbonaceous material during processing can include forming 12 a permeability control infrastructure which defines a substantially encapsulated volume. The method further includes introducing 14 a composite comminuted hydrocarbonaceous material into the control infrastructure to form a permeable body. More specifically, the composite hydrocarbonaceous material can include a comminuted hydrocarbonaceous material and a structural material. The steps of forming the encapsulated volume and introducing the composite material into the encapsulated volume can, and most often will, occur simultaneously. The method can further include heating 16 the permeable body sufficient to remove hydrocarbons therefrom. Depending on the specific composition and structure of the permeable body, the conditions can vary in order to produce and/or liberate hydrocarbons from the permeable body. Typically, the hydrocarbonaceous material is substantially stationary during heating, aside from settling and subsidence due to removal of material from the permeable body. The structural material can provide structural integrity to the permeable body sufficient to maintain convective flow of fluids throughout the permeable body during heating. In one embodiment, the steps of forming and introducing can occur substantially simultaneously. Additionally, the method can further comprise collecting and removing 18 the hydrocarbons.

Generally, the present method can provide an effective means for recovering hydrocarbons from organic rich hydrocarbonaceous materials without substantial subsidence within the constructed permeability control infrastructure. The use of structural materials within the permeable body can maintain a desired porosity such that convective flow of fluids is maintained during processing. Such a method can be particularly effective for comminuted hydrocarbonaceous materials that generally do not maintain porosity under typical processing conditions. The constructed infrastructure can define a substantially encapsulated volume where a composite comminuted hydrocarbonaceous material, including a mined or harvested hydrocarbonaceous material and a structural material, can be introduced into the control infrastructure to form a permeable body of composite material. The control infrastructure can generally be formed at least partially of earthen material to form a barrier to uncontrolled escape of fluids from the impoundment. The permeable body can be heated sufficient to remove hydrocarbons therefrom. During heating, the composite comminuted hydrocarbonaceous material is substantially stationary as the constructed infrastructure is a fixed structure and as the structural material within the composite provides structural integrity during processing. Removed hydrocarbons can be collected for further processing, use in the process, and/or use as recovered.

As such, a constructed permeability control infrastructure can comprise a permeability control impoundment defining a substantially encapsulated volume and a composite comminuted hydrocarbonaceous material within the encapsulated volume forming a permeable body of hydrocarbonaceous material. The composite comminuted hydrocarbonaceous material can comprise comminuted hydrocarbonaceous material and structural material having a porosity, where the structural material is capable of maintaining the porosity of the permeable body during heating of the permeable body within a target porosity range.

Each of these aspects of the present invention is described in further detail below. The constructed permeability control infrastructure can be formed using existing grade as floor support and/or as side wall support for the constructed infrastructure. For example, the control infrastructure can be formed as a free standing structure, i.e. using only existing grade as a floor with side walls and ceiling being man-made. Alternatively, the control infrastructure can be formed within an excavated pit. Regardless, the control infrastructures of the present invention are always formed above-grade.

A constructed permeability control infrastructure can include a permeability control impoundment which defines a substantially encapsulated volume. The permeability control impoundment can be substantially free of undisturbed geological formations. Specifically, the permeability control aspect of the impoundment can be completely constructed and manmade as a separate isolation mechanism for prevention of uncontrolled migration of material into or out of the encapsulated volume. In one embodiment, the constructed permeability control infrastructure can include a permeable body of composite comminuted hydrocarbonaceous material, a layer of gravel fines, a fluid barrier layer of bentonite amended soil (BAS layer), and adjacent native formation. In another embodiment, the control infrastructure at least partially comprises a compacted earthen material. In one aspect, the earthen material can include clay (e.g. high swelling clays, bentonite clay, and the like), compacted fill, refractory cement, cement, clay amended soil, compacted earth, low grade shale, or combinations thereof. In one aspect, the control infrastructure can comprise clay amended soil.

The control infrastructure can often be formed as free-standing berms having underlying earth as structural foundation and support for floors of the infrastructure. In one embodiment, the permeability control impoundment, or control infrastructure, can be formed along walls of an excavated hydrocarbonaceous material deposit. In one alternative aspect, at least one additional excavated hydrocarbonaceous material deposit can be formed such that a plurality of impoundments can be operated. Further, such a configuration can facilitate a reduction in transportation distance of the mined material. Specifically, the mined hydrocarbonaceous material for any particular encapsulated volume can be mined from an adjacent excavated hydrocarbonaceous material deposit. In this manner, a grid of constructed structures can be built such that mined material can be immediately and directly filled into an adjacent impoundment.

The impoundment can be formed of a suitable material which provides isolation of material transfer across walls of the impoundment. In this manner, integrity of the walls is retained during operation of the control infrastructure sufficient to substantially prevent uncontrolled migration of fluids outside of the control infrastructure. Non-limiting examples of suitable material for use in forming the impoundment of the constructed permeability control infrastructure can include clay, bentonite clay (e.g. clay comprising at least a portion of bentonite which includes montmorillonite), compacted fill, refractory cement, cement, synthetic geogrids, fiberglass, rebar, nanocarbon fullerene additives, filled geotextile bags, polymeric resins, oil resistant PVC liners, or combinations thereof. For large scale operations forming the impoundment at least partially of earthen material can provide an effective barrier. Engineered cementitious composites (ECC) materials, fiber reinforced composites, and the like can be particularly strong and can be readily engineered to meet permeability and temperature tolerance requirements of a given installation.

As a general guideline, for the impoundment, materials having low permeability and high mechanical integrity at operating temperatures of the infrastructure can be used. For example, materials having a melting point above the maximum operating temperature of the infrastructure can be useful to maintain containment during and after heating and recovery. However, lower temperature materials can also be used if a non-heated buffer zone is maintained between the walls and heated portions of the permeable body. Such buffer zones can range from 15 cm to 16 meters depending on the particular material used for the impoundment and the composition of the permeable body.

Impoundment walls may be substantially continuous such that the impoundment defines the encapsulated volume sufficiently to prevent substantial movement of fluids into or out of the impoundment other than defined inlets and outlets, e.g. via conduits or the like as discussed herein. In this manner, the impoundments can readily meet government fluid migration regulations. Alternatively, or in combination with a manufactured barrier, portions of the impoundment walls can be undisturbed geological formation and/or compacted earth. In such cases, the constructed permeability control infrastructure is a combination of permeable and impermeable walls as described in more detail below.

In one detailed aspect, a portion of hydrocarbonaceous material, either pre- or post-processed, can be used as a cement fortification and/or cement base which are then poured in place to form portions or the entirety of walls of the control infrastructure. These materials can be formed in place or can be preformed and then assembled on site to form an integral impoundment structure. For example, the impoundment can be constructed by cast forming in place as a monolithic body, extrusion, stacking of preformed or precast pieces, concrete panels joined by a grout (cement, ECC or other suitable material), inflated form, or the like. The forms can be built up against a formation or can be stand alone structures. Forms can be constructed of a suitable material such as, but not limited to, steel, wood, fiberglass, polymer, or the like. Optional binders can be added to enhance compaction of the permeability control walls. The control infrastructure can optionally comprise, or consist essentially of, sealant, grout, rebar, synthetic clay, bentonite clay, clay lining, refractory cement, high temperature geomembranes, drain pipes, alloy sheets, or combinations thereof.

In one embodiment, the construction of impoundment walls and floors can include multiple compacted layers of indigenous or manipulated low grade shale with any combination of sand, cement, fiber, plant fiber, nanocarbons, crushed glass, reinforcement steel, engineered carbon reinforcement grid, calcium, and the like. In addition to such composite walls, designs which inhibit long term fluid and gas migration through additional impermeability engineering can be employed including, but not limited to, liners, geo-membranes, compacted soils, imported sand, gravel or rock and gravity drainage contours to move fluids and gases away from impervious layers to egress exits. Impoundment floor and wall construction, can, but need not comprise, a stepped up or stepped down slope or bench as the case of mining course may dictate following the optimal ore grade mining. In any such stepped up or down applications, floor leveling and containment wall construction can typically drain or slope to one side or to a specific central gathering area(s) for removal of fluids by gravity drainage assistance.

Optionally, capsule wall and floor construction can include insulation which prevents heat transfer outside of the constructed infrastructure or outside of inner capsules or conduits within the primary constructed capsule containment. Insulation can comprise manufactured materials, cement or various materials other materials which are less thermally conductive than surrounding masses, i.e. permeable body, formation, adjacent infrastructures, etc. Thermally insulating barriers can also be formed within the permeable body, along impoundment walls, ceilings and/or floors. The impoundment can be formed as a single use system such that insulations, pipes, and/or other components can have a relatively low useful life, e.g. less than 1-2 years. In his manner, conduits, barrier, and insulation materials can be left in place along with spent feedstock materials upon completion of recovery and shutdown of the system. This can reduce equipment costs as well as reduce long-term environmental impact.

The structures and methods presented herein can be applied at almost any scale. Larger encapsulated volumes and increased numbers of impoundments can readily produce hydrocarbon products and performance comparable to or exceeding smaller constructed infrastructures. As an illustration, single impoundments can range in size from tens of meters across to tens of acres in top plan surface area. Similarly, impoundment depths can vary from several meters up to 100 meters, with about 50 meters providing one exemplary depth. Optimal impoundment sizes may vary depending on the hydrocarbonaceous material and operating parameters, however it is expected that suitable areas per impoundment cell can range from about one-half to fifteen acres in top plan surface area. An array of impoundment cells can be arranged adjacent one another to form a plurality of individually controllable units which can be operated at least partially independent of adjacent cells. Recognition and adjustment of operating parameters can also take into account heat transfer from adjacent cells.

The methods and infrastructures can be used for recovery of hydrocarbons from a variety of hydrocarbonaceous materials. One particular advantage is a wide degree of latitude in controlling particle size, conditions, and composition of the permeable body introduced into the encapsulated volume. Non-limiting examples of mined hydrocarbonaceous material which can be treated comprise oil shale, tar sands, coal, lignite, bitumen, peat, or combinations thereof. Additionally, high organic content material which can be treated can comprise peat, coal, biomass, tar sands, or combinations thereof. In some cases it can be desirable to provide a single type of hydrocarbonaceous material in conjunction with the structural material so that the permeable body consists essentially of a structural material and one of the above hydrocarbonaceous materials. However, the permeable body can include mixtures of these materials such that grade, oil content, hydrogen content, permeability and the like can be adjusted to achieve a desired result. Non-limiting examples of structural materials which can be used include rock, shale, residual hydrocarbonaceous material, spent feedstock, cement, or combinations thereof. Generally, suitable structural materials can be formed of natural or manmade material which has sufficient mechanical compressive strength to preserve void space within a target range during processing. Further, multiple hydrocarbonaceous materials can be placed in segregated layers or in a mixed fashion such as combining coal, oil shale, tar sands, biomass, and/or peat.

As discussed herein, generally the composite comminuted hydrocarbonaceous material is mixed such that porosity of the permeable body is maintained within a target porosity range during hydrocarbon recovery phases of processing. In one embodiment, the permeable body can have a porosity from about 10% to about 80% of the total volume of the permeable body before and during heating. In one aspect, the permeable body can maintain a porosity from about 40% to about 70% of the total volume of the permeable body before and during heating. As such, in one embodiment, the composite comminuted hydrocarbonaceous material can comprise 10 wt % to 60 wt % of structural material and 40 wt % to 90 wt % of comminuted hydrocarbonaceous material. In one aspect, the composite comminuted hydrocarbonaceous material can comprise 20 wt % to 40 wt % of structural material and 60 wt % to 80 wt % of comminuted hydrocarbonaceous material. In another aspect, the composite comminuted hydrocarbonaceous material can provide 50% to 60% porosity. In one embodiment, the permeable body can have a first porosity before heating and a second lower porosity during and after heating which is maintained above 10%.

In one embodiment, hydrocarbon containing material can be classified into various inner capsules or cells within a primary constructed infrastructure for optimization reasons. For instance, layers and depths of mined oil shale formations may be richer in certain depth pay zones as mining progresses. Once blasted, mined, shoveled and hauled inside of a capsule for placement, richer oil bearing ores can be classified or mixed by grade for optimal yields, faster recovery, or for optimal averaging within each impoundment. The ability to selectively control the characteristics and composition of the permeable body adds a significant amount of freedom in optimizing oil yields and quality. Furthermore, the liberated gaseous and liquid products can act as an in situ produced solvent which supplements kerogen removal and/or additional hydrocarbon removal from the hydrocarbonaceous material.

Optionally, the permeable body can further comprise an additive or biomass. Additives can include compositions which act to increase the quality of removed hydrocarbons, e.g. increased API, decreased viscosity, improved flow properties, reduced wetting of residual shale, reduction of sulfur, hydrogenation agents, etc. Non-limiting examples of suitable additives can include bitumen, kerogen, propane, natural gas, natural gas condensate, crude oil, refining bottoms, asphaltenes, common solvents, other diluents, and combinations of these materials. In one specific embodiment, the additive can include a flow improvement agent and/or a hydrogen donor agent. Further, manmade materials can also be used as additives such as, but not limited to, tires, polymeric refuse, or other hydrocarbon-containing materials.

Particle sizes throughout the permeable body can vary considerably, depending on the material type, desired heating rates, and other factors. As a general guideline, the permeable body can include comminuted hydrocarbonaceous particles from about 0.3 cm to about 2 meters on average, and in some cases less than 30 cm and in other cases less than about 16 cm on average. However, as a practical matter, sizes from about 5 cm to about 60 cm on average, or in one aspect about 16 cm to about 60 cm on average, can provide good results with about 30 cm average diameter being useful for oil shale especially. Additionally, the permeable body can include structural materials having an average size from about 16 cm to about 1.5 meters. In one aspect, the structural materials can have an average size from about 30 cm to about 1 meter. In one embodiment, the permeable body can comprise a bimodal size distribution of comminuted hydrocarbonaceous material and structural material. Structural materials can be particulate and often have an average size from about 0.3 cm to about 2 meters. Although the average size can be commensurate with particle size ranges of the hydrocarbonaceous material, in some cases, the structural material can have an average diameter which is larger than an average diameter of the hydrocarbonaceous material. Accordingly, it can be desirable to provide structural material having an average size which is from about 10% to about 500% larger than an average size of the hydrocarbonaceous material. In one aspect, the bimodal size distribution can include a majority of structural material having an average diameter that is at least twice an average diameter of the comminuted hydrocarbonaceous material. In another aspect, the bimodal size distribution can provide a porosity of between 10% and 80% for the permeable body before and during heating. In one specific aspect, the bimodal size distribution can provide a porosity of between 40% and 70% for the permeable body before and during heating.

Void space can be a factor in determining optimal particle diameters. However, about 15% to about 40% and in some cases about 30% usually provides suitable results. Void volumes can be varied somewhat by varying other parameters such as heating conduit placement, particle size distributions (i.e. multimodal distributions), additives, and the like. Mechanical separation of mined hydrocarbonaceous materials can allow for creation of fine mesh, high permeability particles which enhance thermal dispersion rates once placed in capsules within the impoundment, which can be further enhanced by the present structural materials. The added permeability allows for more reasonable, low temperatures which also help to avoid higher temperatures which result in greater $CO_2$ production from carbonate decomposition and associated release of trace heavy metals, volatile organics, and other compounds which can create toxic effluent and/or undesirable materials which can be monitored and controlled.

Figure 2:
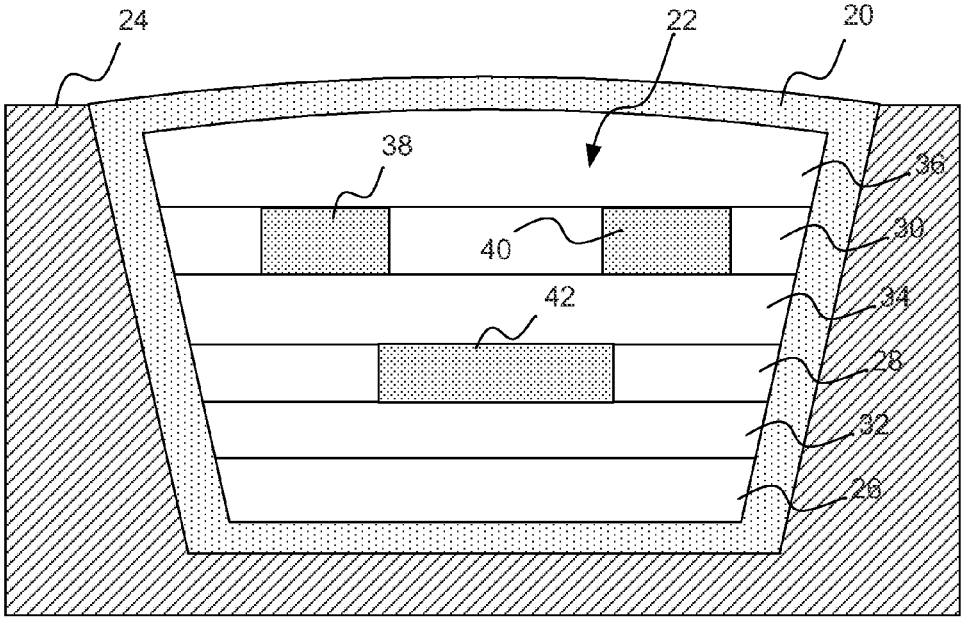
FIG. 2 is a side cross-sectional view of a constructed permeability control infrastructure having zones within the permeable body having varied void volume in accordance with one embodiment of the present invention.

The composite comminuted hydrocarbonaceous material can be filled into the control infrastructure to form the permeable body in a suitable manner. Typically the comminuted hydrocarbonaceous material can be conveyed into the control infrastructure by dumping, conveyors or other suitable approaches. As mentioned previously, the permeable body can have a carefully tailored high void volume. Indiscriminate dumping can result in excessive compaction and reduction of void volumes. Thus, the permeable body can be formed by low compaction conveying of the composite hydrocarbonaceous material into the infrastructure. For example, retracting conveyors can be used to deliver the material near a top surface of the permeable body as it is formed. In this way, the composite hydrocarbonaceous material can retain a significant void volume between particles without substantial further crushing or compaction despite some small degree of compaction which often results from lithostatic pressure as the permeable body is formed. In one alternative illustrated generally in FIG. 2, zones of hydrocarbonaceous material can be formed having varied void volumes. Impoundment walls 20 isolate the permeable body 22 from surrounding formation 24. Lower void volumes can result in lower convective heat currents. Consequently, convective heat flows can be controlled by providing variations in void volumes across the permeable body.

For example, layers of hydrocarbonaceous material can have alternating higher and lower void volumes (i.e. high void volume layers 26, 28 and 30, with low void volume layers 32, 34 and 36). Accordingly, convective heat flow can flow more freely along zones having higher void volume over zones having relatively lower void volume. Low void volume layers can thus act as convective flow retarding layers. Alternatively, or in combination with vertical variations, void volume can be varied horizontally in order to develop convective flows which distribute heat in a desired pattern. For example, low void volume zones 38, 40 and 42 can be distributed to interrupt and/or redirect convective heat flow. Heat distribution uniformity can be increased, localized hot spots can be reduced, and/or convective flow rates can be reduced.

Once a desired permeable body has been formed within the control infrastructure, heat can be introduced sufficient to begin removal of hydrocarbons, e.g. via pyrolysis. A suitable heat source can be thermally associated with the permeable body. Optimal operating temperatures within the permeable body can vary depending on the composition and desired products. However, as a general guideline, operating temperatures can range from about 93° C. to about 430° C. Temperature variations throughout the encapsulated volume can vary and may reach as high as 900° F. or more in some areas. In one embodiment, the operating temperature can be a relatively lower temperature to facilitate production of liquid product such as from about 93° C. to about 340° C. This heating step can be a roasting operation which results in beneficiation of the crushed ore of the permeable body. Generally, products can include both liquid and gaseous products, while liquid products can require fewer processing steps such as scrubbers etc.

Heat can be transferred into and throughout the permeable body primarily via convection. Heated gases can be injected into the control infrastructure such that the heated gases pass throughout the permeable body. Heated gases can be produced by combustion of natural gas, hydrocarbon product, or other suitable source. The heated gases can be imported from external sources or recovered from the process of the present invention. The heated gases can be directed through the permeable body via embedded heating conduits. In this manner, the heating gases can be provided in a closed system to prevent mixing the heated gases with the permeable body.

The plurality of conduits can be readily oriented in a variety of configurations, whether substantially horizontal, vertical, slanted, branched, or the like. At least a portion of the conduits can be oriented along predetermined pathways prior to embedding the conduits within the permeable body. The predetermined pathways can be designed to improve heat transfer, gas-liquid-solid contacting, maximize fluid delivery or removal from specific regions within the encapsulated volume, or the like. Further, at least a portion of the conduits can be dedicated to heating of the permeable body. These heating conduits can be selectively perforated to allow heated gases or other fluids to convectively heat and mix throughout the permeable body. Alternatively, the heating conduits can form a closed loop such that heating gases or fluids are segregated from the permeable body. Thus, a "closed loop" does not necessarily require recirculation, rather isolation of heating fluid from the permeable body. In this manner, heating can be accomplished primarily or substantially only through thermal conduction across the conduit walls from the heating fluids into the permeable body. Heat transfer within the permeable body then proceeds primarily via convective heating.

During the heating or roasting of the permeable body, localized areas of heat which exceed parent rock decomposition temperatures, often above about 480° C., can reduce product quality and form carbon dioxide and release undesirable contaminating components which can lead to leachates containing heavy metals, soluble organics and the like. The heating conduits can allow for substantial elimination of such localized hot spots while maintaining a vast majority of the permeable body within a desired temperature range. The degree of uniformity in temperature can be a balance of cost (e.g. for additional heating conduits) versus yields. However, at least about 85% of the permeable body can readily be heated to a target temperature range with substantially no hot spots, i.e. exceeding the decomposition temperature of the hydrocarbonaceous materials such as about 900° F. Thus, operated as described herein, the systems can allow for recovery of hydrocarbons while eliminating or substantially avoiding production of undesirable leachates.

Although products can vary considerably depending on the starting materials, high quality liquid and gaseous products are possible. For example, without additional treatment, crushed oil shale material can directly produce a liquid product having an API from about 30 to about 45, with about 33 to about 38 being currently typical. Interestingly, it has been found that pressure appears to be a much less influential factor on the quality of recovered hydrocarbons than temperature and heating times. Although heating times can vary considerably, depending on void space, permeable body composition, quality, etc., as a general guideline times can range from an hour up to about one year. In one specific example, heating times can range from about 2 weeks to about 4 months. Under-heating oil shale at short residence times, i.e. minutes, can lead to formation of leachable and/or somewhat volatile hydrocarbons. Accordingly, extended residence times at moderate temperatures can be used such that organics present in oil shale can be volatilized and/or carbonized, leaving insubstantial leachable organics. In addition, the underlying shale is not generally decomposed or altered which reduces release of mineral bound components.

Further, walls of the constructed infrastructure can be configured to minimize heat loss. In one aspect, the walls can be constructed having a substantially uniform thickness which is optimized to provide sufficient mechanical strength while also minimizing the volume of wall material through which the conduits pass. Specifically, excessively thick walls can reduce the amount of heat which is transferred into the permeable body by absorbing the same through conduction. Conversely, the walls can also act as a thermal barrier to somewhat insulate the permeable body and retain heat therein during operation.

Additionally, in one embodiment, the present constructed permeability control infrastructure can be heated and/or cooled under specific temperature profiles to substantially eliminate or minimize the formation of unwanted accumulated hydrocarbon material. Generally, the present infrastructures can be operated to heat at least a portion of the permeable body to a bulk temperature above a production temperature sufficient to remove hydrocarbons therefrom, where conditions in non-production zones are maintained below the production temperature. In one aspect, the infrastructure can have a production temperature ranging from at least 93° C. to 480° C. In another aspect, the infrastructure can have a bulk temperature ranging from over 93° C. to 480° C. In one detailed aspect, the bulk temperature can be between 200° C. and 480° C.

In order to decrease or eliminate the amount of liquids retained in the non-production zone, several conditions can be maintained. As discussed above, during operation of the system, temperatures below the liquid collection system can be maintained below a production temperature for the corresponding hydrocarbonaceous materials. As a result, materials in the non-production zone do not produce hydrocarbons. Further, the fluid barrier properties of the impoundment barrier layer can be maintained. For example, when using bentonite amended soil (BAS) the fluid barrier properties are maintained as long as the BAS layer is hydrated. During operation, hydration can be maintained by keeping temperatures throughout the BAS layer below about 100° C., or more typically below about 93° C. in order to avoid hot spots and localized dehydration of the BAS.

Figure 3:
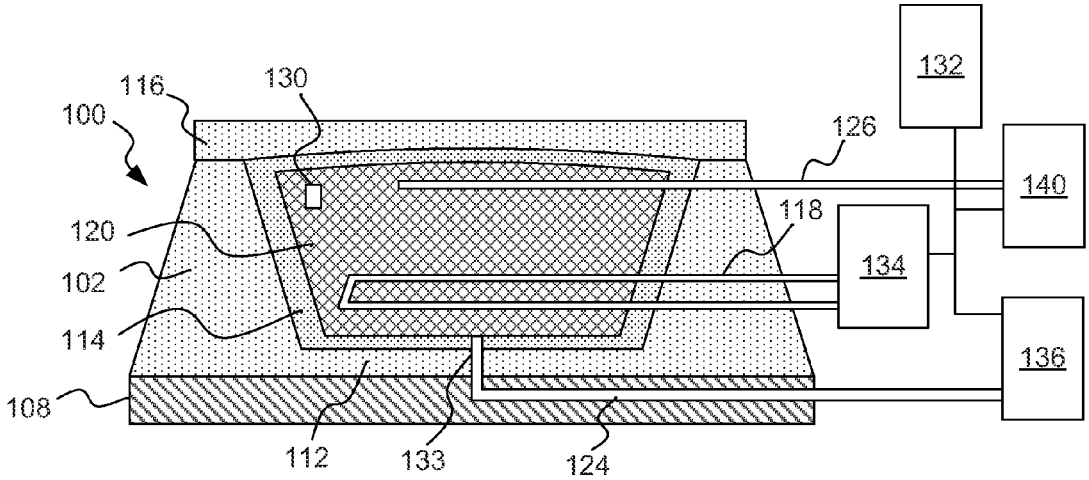
FIG. 3 is side partial cutaway view schematic of a constructed permeability control infrastructure in accordance with one embodiment of the present invention.

With the above description in mind, FIG. 3 depicts a side view of an engineered capsule containment and extraction impoundment 100 where existing grade 108 is used primarily as support for the impermeable floor layer 112. Exterior capsule impoundment side walls 102 provide containment and can, but need not be, subdivided by interior walls. Subdividing can create separate containment capsules or cells within a greater capsule containment of the impoundment 100 which can be any geometry, size or subdivision. Further subdivisions can be horizontally or vertically stacked. By creating separate containment capsules or chambers, classification of lower grade materials, varied gases, varied liquids, varied process stages, or other desired and staged processes can be readily accommodated. Such sectioned capsules can provide additional environmental monitoring and can be built of lined and engineered tailings berms similar to the primary exterior walls. Lower content hydrocarbon bearing material can be useful as a combustion material, as fill, or as a berm wall building material.

Walls 102 as well as cap 116 and floor 112 can be engineered and reinforced by gabions and/or geogrid layered in fill compaction. Alternatively, these walls 102, 112 and 116 which comprise the permeability control impoundment and collectively define the encapsulated volume can be formed of any other suitable material as previously described. In this embodiment, the impoundment 100 includes side walls 102 which are self-supporting. In one embodiment, tailings berms, walls, and floors can be compacted and engineered for structure as well as permeability. As such, the walls and floors can often be formed of compacted particulate earthen material (e.g. compacted soil, bentonite amended soil, spent shale, gravel, combinations of these, or the like). The use of compacted geogrids and other deadman structures for support of berms and embankments can be included prior to or incorporated with permeability control layers which may include sand, clay, bentonite clay, gravel, cement, grout, reinforced cement, refractory cements, insulations, geo-membranes, drainpipes, temperature resistant insulations of penetrating heated pipes, etc. In one embodiment, the control infrastructure can be free-standing having berms as sidewalls. In one aspect, the berms can comprise a compacted earthen material.

In one alternative embodiment, the permeability control impoundment can include side walls which are compacted earth and/or undisturbed geological formations while the cap and floors are impermeable. Specifically, in such embodiments an impermeable cap can be used to prevent uncontrolled escape of gases from the impoundment such that appropriate gas collection outlets can be used. Similarly, an impermeable floor 112 can be used to contain and direct collected liquids to a suitable outlet such the drain system 133 to remove liquid products from lower regions of the impoundment 100. In one aspect, the substantially impermeable floor can be supported by earth. Although impermeable side walls can be desirable in some embodiments, such are not always required. In some cases, side walls can be exposed undisturbed earth or compacted fill or earth, or other permeable material. Having permeable side walls may allow some small egress of gases and/or liquids from the impoundment. Impermeable walls are formed so as to prevent substantial egress of produced fluids from the impoundment through the impermeable wall during operation of the system.

Once wall structures 102 have been constructed above a constructed and impermeable floor layer 112, the mined rubble 120 (which may be crushed or classified according to size or hydrocarbon richness), can be placed in layers upon (or next to) tubular heating pipes 118, fluid drainage pipes 124, and, or gas gathering or injection pipes 126. These pipes can be oriented and designed in a variety of optimal flow pattern, angle, length, size, volume, intersection, grid, wall sizing, alloy construction, perforation design, injection rate, and extraction rate. In some cases, pipes such as those used for heat transfer can be connected to, recycled through or derive heat from heat source 134. Alternatively, or in combination with, recovered gases can be condensed by a condenser 140. Heat recovered by the condenser can be optionally used to supplement heating of the permeable body or for other process needs.

Heat source 134 can derive, amplify, gather, create, combine, separate, transmit or include heat derived from a suitable heat source including, but not limited to, fuel cells, solid oxide fuel cells, solar sources, wind sources, hydrocarbon liquid or gas combustion heaters, geothermal heat sources, nuclear power plant, coal fired power plant, radio frequency generated heat, wave energy, flameless combustors, natural distributed combustors, geothermal heat, or combinations thereof. In another embodiment, electrically conductive material can be distributed throughout the permeable body and an electric current can be passed through the conductive material sufficient to generate heat. In one embodiment, heating of the permeable body can be accomplished by convective heating from hydrocarbon combustion. Of particular interest is hydrocarbon combustion performed under stoichiometric conditions of fuel to oxygen. Stoichiometric conditions can allow for significantly increased heat gas temperatures. The combustion off gases can then be sequestered without the need for further separation, i.e. because the off gas is predominantly carbon dioxide and water.

Alternatively, in-capsule combustion can be initiated inside of isolated capsules within a primary constructed capsule containment structure. This process partially combusts hydrocarbonaceous material to provide heat and intrinsic pyrolysis. Unwanted air emissions can be captured and sequestered in a formation 108 once derived from capsule containment or from heat source 134 and delivered by a drilled well bore. Heat source 134 can also create electricity and transmit power via electrical transmission lines. The liquids or gases extracted from capsule impoundment treatment area can be stored in a nearby holding tank 136 or within a capsule containment such as impoundment 100. For example, the impermeable floor layer 112 can optionally include a sloped area which directs liquids towards drain system 133 where liquids are directed to the holding tank 136.

As rubble material 120 is placed with piping 118 and 126, various measurement devices or sensors 130 can be used to monitor temperature, pressure, fluids, gases, compositions, heating rates, density, and other process attributes during the extractive process within, around, or underneath the engineered capsule containment impoundment 100. Such monitoring devices and sensors 130 can be distributed anywhere within, around, part of, connected to, or on top of placed piping 118 and 126 or, on top of, covered by, or buried within rubble material 120 or impermeable barrier floor 112.

As placed rubble material 120 fills the capsule treatment area, the rubble material becomes the ceiling support for engineered impermeable cap 116, and wall barrier construction, which can include any combination of impermeability and engineered fluid and gas barrier or constructed capsule construction comprising those which may make up walls 102 and 112 including, but not limited to clay, compacted fill or import material, cement or refractory cement containing material, geo synthetic membrane, liner or insulation. Above, fill material is placed to create lithostatic pressure upon rubble material 120 within the capsule treatment areas. Typically, a fines and/or insulation layer 114 can also be included and which encapsulates the rubble material. This insulation layer can include, for example, hydrated swellable clays, fines, or the like. Covering the permeable body with compacted fill sufficient to create an increased lithostatic pressure within the permeable body can be useful in further increasing hydrocarbon product quality. A compacted fill ceiling can substantially cover the permeable body, while the permeable body in return can substantially support the compacted fill ceiling. The compacted fill ceiling can further be sufficiently impermeable to liberated hydrocarbon or an additional layer of permeability control material can be added in a similar manner as side and/or floor walls.

Additional pressure can be introduced into extraction capsule treatment area by increasing gas or fluid once extracted, treated or recycled, as the case may be, via any suitable piping. Relative measurements, optimization rates, injection rates, extraction rates, temperatures, heating rates, flow rates, pressure rates, capacity indicators, chemical compositions, or other data relative to the process of heating, extraction, stabilization, sequestration, impoundment, upgrading, refining or structure analysis within the capsule impoundment 100 can be acquired through connection to a computing device 132 which operates computer software for the management, calculation and optimization of the entire process and which is operatively connected to the heat source 134, the sensor 130, and any other associated components such as the holding tank 136 or condenser 140.

Figure 4:
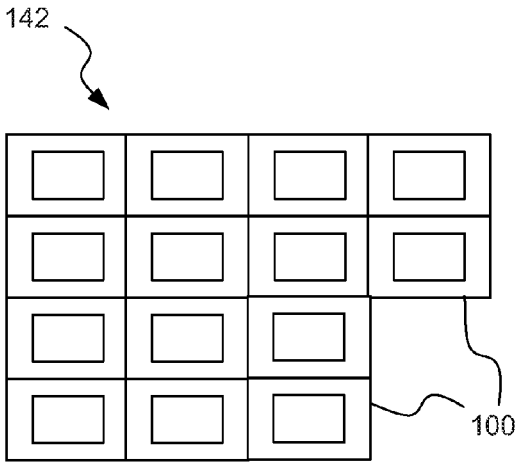
FIG. 4 is a top plan view of a plurality of permeability control impoundments forming an impoundment array in accordance with one embodiment of the present invention.

FIG. 4 shows a collection of impoundments including an uncovered or uncapped capsule system 142, containing individual capsule impoundments 100. In some embodiments, it is envisioned that mining rubble can be transferred down chutes or via conveyors to the quarry capsule impoundments 100. Regardless, multiple impoundments can be oriented adjacent one another to form an array. Access paths for transport, maintenance, conduit, or other features can be introduced to facilitate operation of the system.

Referring back to FIG. 3, computer 130 can be used to control various property inputs and outputs of conduits connected to heat source 134 during the process and can coordinate flows among subdivided impoundments within a collective impoundment system 142 such as illustrated in FIG. 4 to control heating of the permeable body. Similarly, liquid and vapor collected from the impoundments can be monitored and collected in tank 136 and condenser 140, respectively. As described previously, the liquid and vapor products can be combined or more often left as separate products depending on condensability, target product, and the like. A portion of the vapor product can be condensed and combined with the liquid products in tank 136. However, much of the vapor product will often be C4 and lighter gases which can be burned, sold or used within the process. For example, hydrogen gas may be recovered using conventional gas separation and used to hydrotreat the liquid products according to conventional upgrading methods, e.g. catalytic, etc. or the non-condensable gaseous product can be burned to produce heat for use in heating the permeable body, heating an adjacent or nearby impoundment, heating service or personnel areas, or satisfying other process heat requirements. The constructed infrastructure can include thermocouples, pressure meters, flow meters, fluid dispersion sensors, richness sensors and other conventional process control devices distributed throughout the constructed infrastructure. These devices can be each operatively associated with a computer such that heating rates, product flow rates, and pressures can be monitored or altered during heating of the permeable body.

Figure 5:
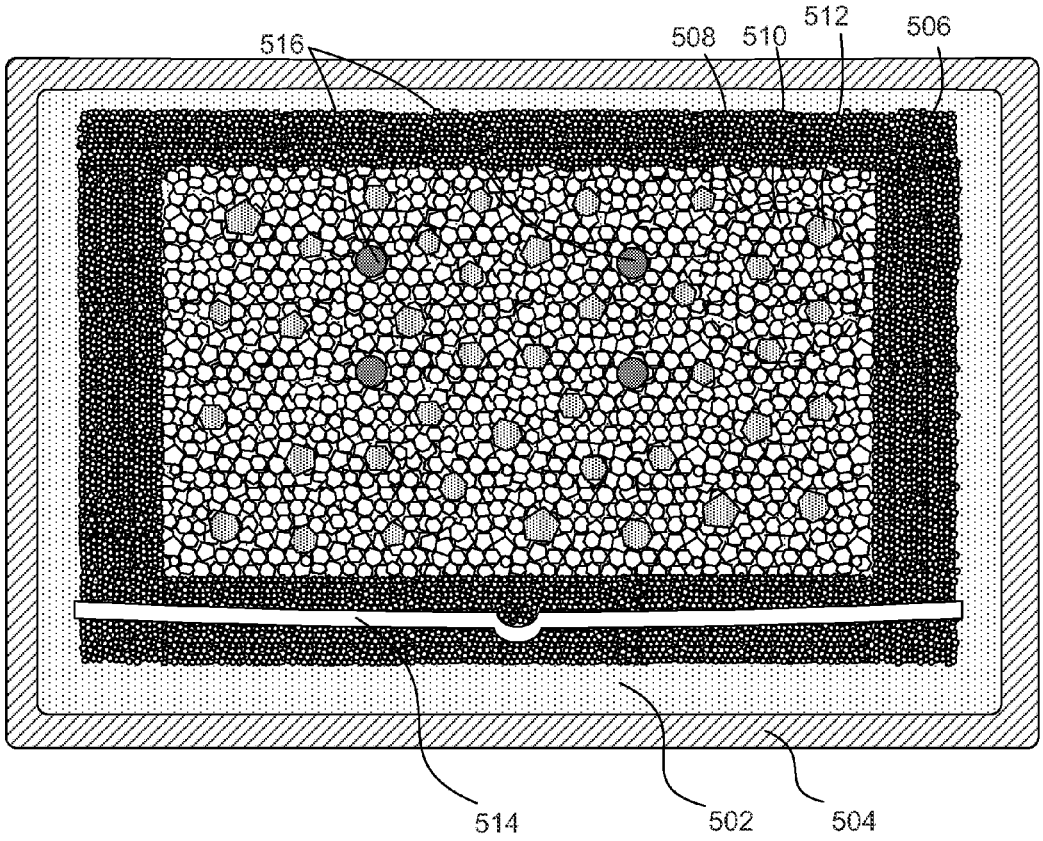
FIG. 5 is a side cutaway view of a permeability control impoundment in accordance with one embodiment of the present invention.

Referring to FIG. 5, a fluid barrier layer 502 of bentonite amended soil (BAS) is formed adjacent native formation 504 or other structure (e.g. an adjacent impoundment). A layer of gravel fines 506 is also provided adjacent the BAS layer to form an insulating layer. Encapsulated within the layer of gravel fines is a permeable body 508 (portion of which is circled) of comminuted oil shale 510 and structural material 512 forming a production volume having average particle sizes that are suitable for production of hydrocarbons. Typically, the gravel fines layer can comprise crushed oil shale having an average particle size substantially smaller than the average particle size within the production volume.

An optional primary liquid collection system 514 can be oriented within a lower portion of the crushed oil shale within the layer of gravel fines. Although the primary liquid collection system is shown in the gravel layer midway between the permeable body and the BAS layer, such location is for illustration purposes and is not intended to be limiting. As such, the primary liquid collection system can located approximately midway, in the upper portion of the gravel layer, or in the lower portion of the gravel layer. The liquid collection system can be configured to collect fluids across the entire cross-section of the permeable body. The collections system can be a single continuous layer, or may be formed of multiple discrete collection trays. In one example, the liquid collection system can be a drain pan which extends through the layer of gravel fines to the surrounding BAS layer. The drain pan can optionally include one or more drain channels which direct fluid toward a common collection point for removal via a corresponding outlet. Although removal can be accomplished via pumping, typically gravity drainage can provide sufficient removal flow rates. In one aspect, the drain pan can cover the entire floor of the infrastructure. A plurality of heating conduits 516 can be embedded within the permeable body so as to heat the oil shale sufficient to initiate pyrolysis and production of hydrocarbons.

During operation, the permeable body of hydrocarbonaceous material is heated to a predetermined production temperature corresponding to liberation and/or production of hydrocarbons from the corresponding hydrocarbonaceous material. However, the entire system typically exhibits temperature gradients which vary throughout. For example, for oil shale processing, the permeable body may have a peak bulk temperature around 400° C. with a decreasing temperature gradient approaching the surrounding formation which is often around 15° C. In order to decrease or eliminate the amount of liquids retained in the non-production zone, several conditions can be created and maintained. During operation of the system, temperatures below the liquid collection system can be maintained below a production temperature for the corresponding hydrocarbonaceous materials. As a result, materials in the non-production zone do not produce hydrocarbons.

Further, the fluid barrier properties of the BAS layer can be maintained as long as the BAS layer is hydrated. Upon dehydration, the BAS layer reverts to a particulate state allowing fluids to pass. During operation, hydration can be maintained by keeping temperatures throughout the BAS layer below 93° C. Additionally, the infrastructures can optionally further include hydration mechanisms to supply water to the BAS layer. Such hydration mechanisms can be located along the BAS layer such that adequate hydration of the BAS layer is achieved so as to preserve substantial fluid impermeability during operation.

Temperature at the primary liquid collection system and the BAS layer can be controlled by adjusting heating rates from the bulk heating conduits, varying void space within the permeable body, varying thickness of the gravel fines layer, and adjusting the fluid removal rates via the drain system. Optional supplemental cooling loops can be provided to remove heat from near the primary liquid collection system and/or the BAS layer.

Hydrocarbon products recovered from the permeable body can be further processed (e.g. refined) or used as produced. Condensable gaseous products can be condensed by cooling and collection, while non-condensable gases can be collected, burned as fuel, reinjected, or otherwise utilized or disposed of. Optionally, mobile equipment can be used to collect gases. These units can be readily oriented proximate to the control infrastructure and the gaseous product directed thereto via suitable conduits from an upper region of the control infrastructure.

In yet another alternative embodiment, heat within the permeable body can be recovered subsequent to primary recovery of hydrocarbon materials therefrom. For example, a large amount of heat is retained in the permeable body. In one optional embodiment, the permeable body can be flooded with a heat transfer fluid such as water to form a heated fluid, e.g. heated water and/or steam. At the same time, this process can facilitate removal of some residual hydrocarbon products via a physical rinsing of the spent shale solids. In some cases, the introduction of water and presence of steam can result in water gas shift reactions and formation of synthesis gas. Steam recovered from this process can be used to drive a generator, directed to another nearby infrastructure, or otherwise used. Hydrocarbons and/or synthesis gas can be separated from the steam or heated fluid by conventional methods.

Synthesis gas can also be recovered from the permeable body during the step of heating. Various stages of gas production can be manipulated through processes which raise or lower operating temperatures within the encapsulated volume and adjust other inputs into the impoundment to produce synthetic gases which can include but are not limited to, carbon monoxide, hydrogen, hydrogen sulfide, hydrocarbons, ammonia, water, nitrogen or various combinations thereof.

Hydrocarbon product recovered from the constructed infrastructures can most often be further processed, e.g. by upgrading, refining, etc. Similarly, spent hydrocarbonaceous material remaining in the constructed infrastructure can be left in place or utilized in the production of cement and aggregate products for use in construction or stabilization of the infrastructure itself or in the formation of offsite constructed infrastructures. Such cement products made with the spent shale may include, but are not limited to, mixtures with Portland cement, calcium, volcanic ash, perlite, synthetic nanocarbons, sand, fiber glass, crushed glass, asphalt, tar, binding resins, cellulosic plant fibers, and the like.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A method of reducing settling of residual comminuted hydrocarbonaceous material during processing, comprising:

a) forming a constructed permeability control infrastructure which defines a substantially encapsulated volume;

b) introducing a composite comminuted hydrocarbonaceous material into the control infrastructure to form a permeable body, said composite hydrocarbonaceous material comprising a comminuted hydrocarbonaceous material mixed with a particulate structural material; and c) heating the permeable body sufficient to remove hydrocarbons therefrom such that the hydrocarbonaceous material is substantially stationary during heating, exclusive of subsidence and settling;

wherein the structural material provides structural integrity to the permeable body sufficient to maintain convective flow of fluids and preserve void space throughout the permeable body during heating.

2. The method of claim 1, wherein forming and introducing occur substantially simultaneously.

3. The method of claim 1, further comprising collecting and removing the hydrocarbons.

4. The method of claim 3, wherein the step of collecting and removing the hydrocarbons includes collecting a liquid product from a lower region of the control infrastructure and collecting a gaseous product from an upper region of the control infrastructure, and wherein the upper region is oriented above the lower region.

5. The method of claim 1, wherein the control infrastructure at least partially comprises a compacted particulate earthen material.

6. The method of claim 5, wherein the earthen material includes clay, bentonite clay, compacted fill, refractory cement, cement, bentonite amended soil, compacted earth, low grade shale, or combinations thereof.

7. The method of claim 1, wherein the constructed permeability control infrastructure comprises bentonite amended soil.

8. The method of claim 1, wherein the infrastructure has a floor which is structurally supported by underlying earth.

9. The method of claim 1, wherein the control infrastructure is free-standing having berms as sidewalls.

10. The method of claim 1, wherein the comminuted hydrocarbonaceous material comprises oil shale, tar sands, coal, lignite, bitumen, peat, or combinations thereof.

11. The method of claim 1, wherein the comminuted hydrocarbonaceous material comprises a high organic content material including peat, coal, biomass, tar sands, or combinations thereof.

12. The method of claim 1, wherein the structural material comprises rock, shale, residual comminuted hydrocarbonaceous material, conventional cement, or combinations thereof.

13. The method of claim 1, wherein the permeable body comprises a bimodal size distribution of comminuted hydrocarbonaceous material and structural material.

14. The method of claim 13, wherein the bimodal size distribution includes a majority of structural material having an average diameter that is at least twice an average diameter of the comminuted hydrocarbonaceous material.

15. The method of claim 13, wherein the bimodal size distribution provides a porosity of between 10% and 80% for the permeable body before and during heating.

16. The method of claim 1, wherein the permeable body maintains a porosity from about 40% to about 70% of the total volume of the permeable body before and during heating.

17. The method of claim 1, wherein the permeable body has a first porosity before heating and a second lower porosity during heating which is maintained above 10%.

18. The method of claim 1, wherein the control infrastructure is substantially free of undisturbed geological formations.

19. The method of claim 1, wherein the permeable body further comprises a plurality of heating conduits embedded within the permeable body, said plurality of heating conduits adapted to heat the permeable body.

20. The method of claim 1, wherein the permeable body fills the encapsulated volume.

21. The method of claim 1, wherein the permeability control infrastructure forms a fluid barrier.

22. The method of claim 1, wherein the structural material is not electrically conductive.

* * * * *